US005413336A

United States Patent [19]

Iwanaga

[11] Patent Number: 5,413,336

[45] Date of Patent: May 9, 1995

[54] IRON (CLUB) SET

[75] Inventor: Takeshi Iwanaga, Kobe, Japan

[73] Assignee: Sumitomo Rubber Industries, Ltd., Kobe, Japan

[21] Appl. No.: 124,482

[22] Filed: Sep. 22, 1993

[30] Foreign Application Priority Data

Oct. 22, 1992 [JP] Japan ..... 4-309330

[51] Int. Cl.[6] ..... A63B 53/04

[52] U.S. Cl. ..... 273/77 A; 273/167 F; 273/167 J

[58] Field of Search ... 273/77 A, 167 A, 167 F–167 J, 273/171, 173

[56] References Cited

U.S. PATENT DOCUMENTS

| | | | |
|---|---|---|---|
| 4,754,969 | 7/1988 | Kobayashi | 273/77 A |
| 4,802,672 | 2/1989 | Long | 273/77 A |
| 5,209,473 | 5/1993 | Fisher | 273/77 A |

*Primary Examiner*—V. Millin
*Assistant Examiner*—Steven B. Wong
*Attorney, Agent, or Firm*—Armstrong, Westerman, Hattori, McLeland & Naughton

[57] ABSTRACT

An iron set comprises a plurarity of irons respectively provided with a head which is formed with a cavity in a rear surface thereto. A lower size number of irons are gradually still greater in their horizontal face length, and are gradually still smaller in thickness of their ball hitting portions which ranges between their faces and the bottoms of the cavities in their rear surfaces.

8 Claims, 3 Drawing Sheets

IRON (CLUB) SET

BACKGROUND AND SUMMARY OF THE INVENTION

The present invention relates to an iron set. In general, the iron sets respectively comprise No. 3 iron to No. 9 iron, a pitching wedge and a sand wedge, making a total of 9 clubs. However, the sand wedge is for the exclusive use of a ball shot at a bunker, and is furnished with a special function. Occasionally, therefore, the iron sets respectively comprise a total of 8 clubs without the sand wedge.

Alternatively, each iron set may occasionally comprise a total of 10 clubs by including in a total of 9 clubs as described in the foregoing an alternative wedge which is greater in the loft angle thereof than the pitching wedge.

In such a conventional iron set, the component irons are gradually increased in the weight of their heads according to a rise in their size numbers. Moreover, each iron of the conventional iron set remains substantially constant in the horizontal length of the face thereof regardless of the size number thereof. Therefore, the moment of inertia acting upon their heads gradually augments, with an increase in the size numbers of the clubs.

As is apparent from the foregoing description, in the conventional iron set, a lower size number of component clubs are gradually still smaller in the moment of inertia upon their heads, and are accordingly smaller in what is called the sweet-spot areas in them. As a result, a lower size number of component clubs are inferior in their ball orientability in which the flying direction of a golf ball hit thereby is controlled.

Moreover, a lower size number of clubs in the conventional iron set are still greater in the length of their shafts, and are therefore still more reduced in the probability in which they achieve nice shots of golf balls, thereby resulting in deterioration of their ball orientability.

These are disadvantages or problems of the conventional iron set.

It is therefore an object of the present invention to provide an iron set in which the foregoing disadvantage or problem of inferiority in the ball orientability, which is found in a lower size number of clubs is overcome, in which a total number of component clubs assume an orderly and disharmony-free external appearance therein, and in which manufacturing of the component clubs eliminate any necessity of any complicated manufacturing process such as casting into their head portions weight means great in the specific gravity thereof.

BRIEF DESCRIPTION OF THE DRAWINGS

The present invention will be described with reference to the accompanying drawings, in which.

DETAILED DESCRIPTION OF THE PREFERRED EMBODIMENTS

The first preferred embodiment of the iron set according to the present invention will be described in detail with reference to the accompanying drawings.

Figure 1:
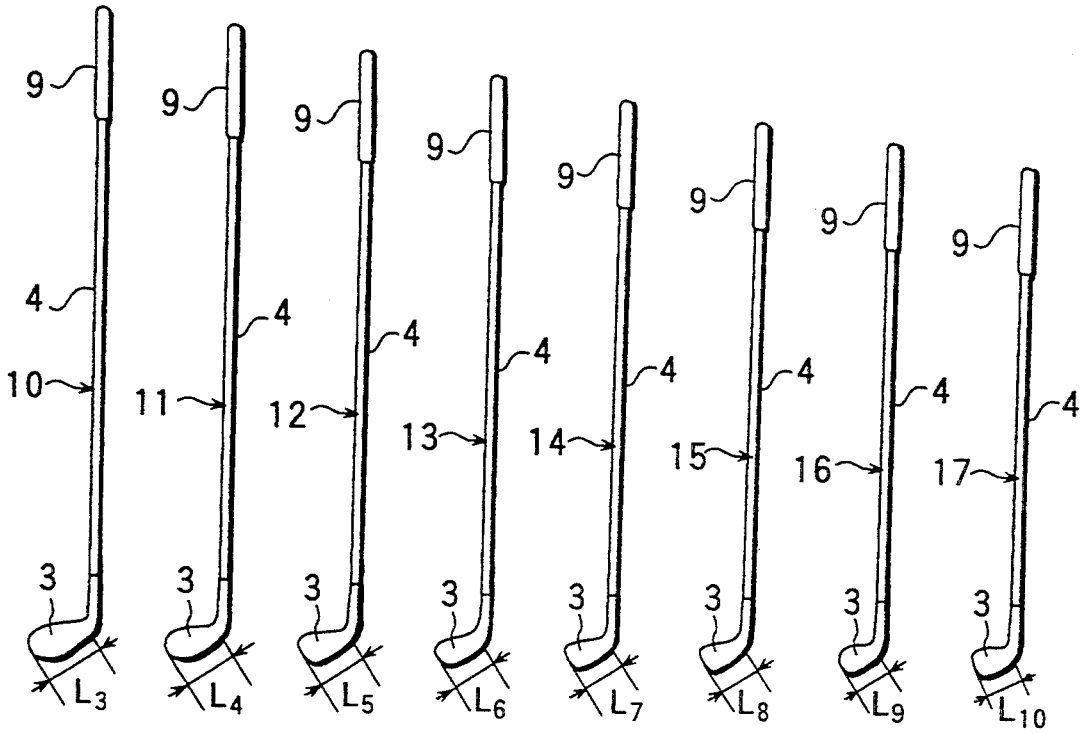
FIG. 1 is an elevational view of the iron set of the present invention according to a first preferred embodiment thereof.

In FIG. 1 which shows an iron set according to the present invention, this iron set comprises a total of 8 clubs, No. 3 iron 10, No. 4 iron 11, No. 5 iron 12, No. 6 iron 13, No. 7 iron 14, No. 8 iron 15, No. 9 iron 16 and a pitching wedge 17. However, this iron set may comprise a total of 9 irons or 10 irons by adding to the foregoing component clubs a sand wedge or a combination of a sand wedge and an alternative wedge.

Each size number of iron is provided with a head 3 at one end thereof and with a grip 9 at the other end thereof. Also, the irons are gradually increased in their length, gradually decreased in their loft angles, and are gradually diminished in their head weight according to reduction in their size numbers. This is precisely as in the conventional iron club sets.

Figure 3:
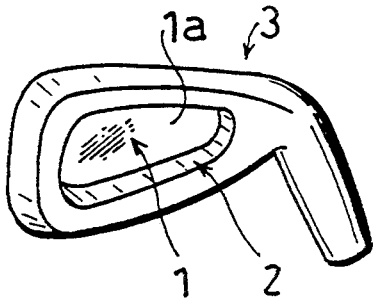
FIG. 3 is a perspective view of the head of FIG. 2 as viewed from the rear side thereof.

In the iron set of the present invention, as shown in FIG. 3, the head 3 of each component iron is provided with a cavity 1 on the back side 2 thereof. This is generally called the cavity-back construction.

Figure 2:
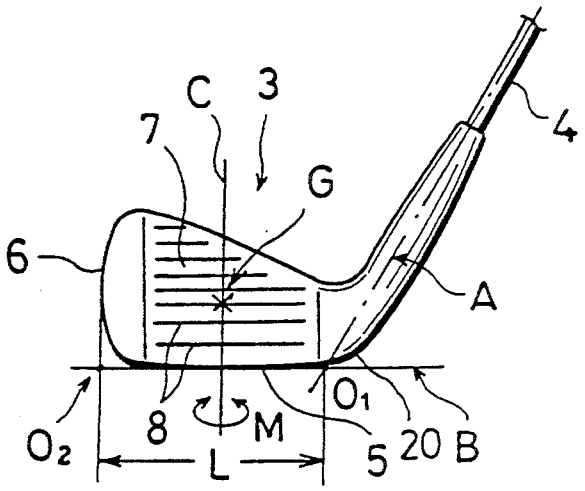
FIG. 2 is an elevational view of the head of a club which forms with the other clubs the iron set of the present invention.

As shown in FIGS. 1 and 2, in the iron set according to the present invention, the component irons have their horizontal face length L set so as to become gradually larger according to a decrease in their size numbers, which is in effect expressed in the following inequality in which L3 is the horizontal face length of No. 3 iron 10, L4 that of No. 4 iron 11, L5 that of No. 5 iron 12, L6 that of No. 6 iron 13, L7 that of No. 7 iron 14, L8 of No. 8 iron 15, L3 that of No. 9 iron 16, and L10 that of the pitching wedge 17.

$$L3>L4>L5>L6>L7>L8>L9>L10$$

In other words, the horizontal face length L of the component irons is increased with every decrease in their size number at a fixed dimensional difference, at a fixed ratio or at a predetermined proportion. The horizontal face length L discussed herein is, as is apparent from FIG. 2, a distance between an intersecting point of an extension line of an axis A of the club shaft with a horizontal line B which is in contact with the bottom of a sole portion 5 and an intersecting point of a horizontal line B with a perpendicular line extending downwardly from the end of a toe portion 6.

Next, in the iron set of the present invention 4, the component irons are arranged to become gradually still smaller according to reduction in their size numbers from their faces 7 to their bottom surfaces 1*a* of the cavities 1 in their back sides 2, which thickness is named thickness T of their ball hitting portions in the present invention.

Figure 4C:
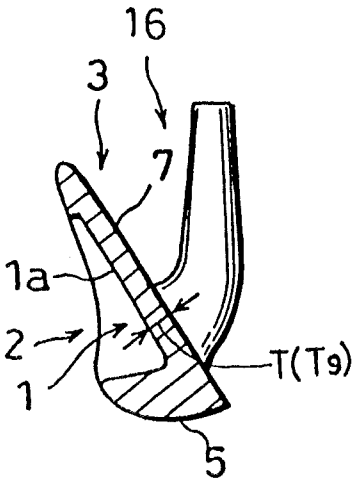
FIG. 4 shows cross-sectional views of three different size numbers of typical clubs in the iron set of the present invention.
Figure 4B:
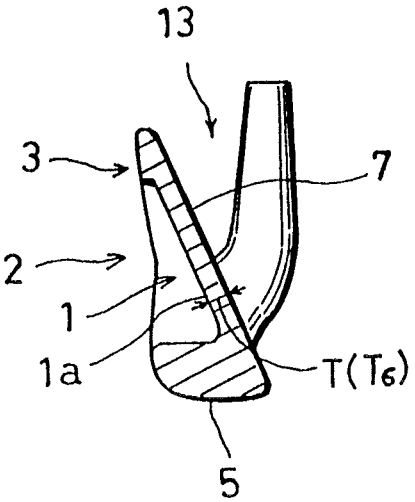
Figure 4A:
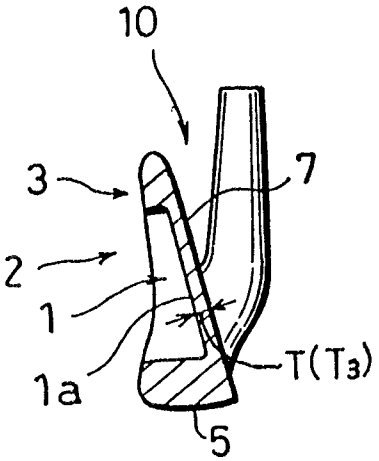

In FIG. 4, three typical irons are only shown which are No. 3 iron 10, No. 6 iron 13 and No. 9 iron 16. If the thickness T of each ball hitting portion is represented by T3 for No. 3 iron 10, T4 for No. 4 iron 11, T5 for No. 5 iron 12, T6 for No. 6 iron 13, T7 for No. 7 iron 14, T8 for No. 8 iron 15, T9 for No. 9 iron 16, and T17 for the pitching wedge 17, the following inequality is obtained.

$$T3<T4<T5<T6<T8<T9<T10$$

The ball hitting portion thickness T of the component irons is thus gradually reduced with every decrease in their size numbers at a fixed dimensional difference, at a fixed ratio or at a predetermined proportion.

Since the component irons are gradually decreased in their ball hitting portion thickness T according to a reduction in their size numbers, a lower size number of irons are allowed be sufficiently weighted on their toe 6 sides and their heel 20 sides. (See FIG. 2.) This cooperates with the arrangement in which the horizontal face length L of a lower component irons is increased according to reduction in their size numbers, to produce a synergistic effect in which a lower size number of irons are allowed to augment in the moment of inertia, M acting upon their heads.

The moment of inertia, M discussed herein is about a straight line C which intersects at right angles with grooves 8 made in the face 7, and passes through the center of gravity, G of the head 3 in parallel with the face 7 in FIG. 2.

In the iron set of the present invention, as described in the foregoing, the component irons are arranged to allow the moment of inertia, M to gradually increase according to a decrease in their size numbers. This arrangement is an inventive technological conception which are not found in the conventional iron set.

ponent irons thus arranged assume an orderly and disharmony-free external appearance if they are totally viewed as a set of clubs. Therefore, the iron set thus obtained according to the present invention has an advantage in that any golfer who uses it does not feel any psychic burden in golfing generally said to be a mental sport.

In order to increase the moment of inertia upon the head of each component iron, it is possible to join thereto a piece of metal which is greater in the specific gravity thereof. However, this necessitates additional complicated manufacturing processes, thereby causing an increase in the manufacturing cost. However, in the present invention, manufacturing of iron sets is feasible at a lower cost. This is a great advantage of the present invention.

The following Table 1 shows the head weight, the horizonal face length L and the thickness T of the ball hitting portions of the component clubs of an iron set to which the present invention is applied.

In Table 1, the head weight, the horizonal face length and the thickness of the ball hitting portion are also shown for a conventional iron set which comprises No. 3 iron to No. 9 iron and the pitching wedge as the iron set according to the present invention, to thereby compare their values between the conventional iron set and the iron set according to the present invention.

TABLE 1

| | Head Weight (g) | | Horizonal Face Length L (mm) | | Thickness T of the Ball Hitting Portion (mm) | |
|---|---|---|---|---|---|---|
| | Iron Set of the Present Invention | Conventional Iron Set | Iron Set of the Present Invention | Conventional Iron Set | Iron Set of the Present Invention | Conventional Clubs (Value in the middle of the face) |
| No. 3 Iron | 241 | 241 | 81.0 | 76.0 | 2.5 | 6.0 |
| No. 4 Iron | 247 | 247 | 80.5 | 76.0 | 3.0 | 6.0 |
| No. 5 Iron | 254 | 254 | 80.0 | 76.0 | 3.5 | 6.0 |
| No. 6 Iron | 261 | 261 | 79.5 | 76.0 | 4.0 | 6.0 |
| No. 7 Iron | 268 | 268 | 79.0 | 76.0 | 4.5 | 6.0 |
| No. 8 Iron | 275 | 275 | 78.5 | 76.0 | 5.0 | 6.0 |
| No. 9 Iron | 282 | 282 | 78.0 | 76.0 | 5.5 | 6.0 |
| Pitching Wedge | 292 | 292 | 77.5 | 76.0 | 6.0 | 6.0 |

For precaution's sake, the size number of the component clubs are now described. Usually, the component clubs of an iron set are called No. 3 iron, No. 4 iron . . . No. 9 iron, or the pitching wedge. The numbers of the clubs show the size, or the dimensional magnitude of the clubs, and the clubs are decreased in their size according to reduction in their size. (In an iron set in which No. 3 iron is the first component club thereof, No. 3 iron is of the smallest size.)

In the head 3 of each size number of iron, the thickness T of the ball hitting portion is desired to be substantially even at any portion thereof. (Only for the purpose of comparison, it is mentioned that the head of the cavity-back construction of each iron in the conventional iron set is increased in the ball hitting portion thickness with an approach to the sole side.)

In the iron set according to the present invention, the component irons are all made of the same material, and are varied in both their horizontal face length and the thickness T of their ball hitting portions with every size number at a fixed proportion. For this reason, the com- As is apparent from Table 1, the head weight is gradually increased according to an increase in the size numbers of the clubs in both the conventional iron set and the iron set of the present invention. Also, in the iron set of the present invention, a lower size number of irons are separately gradually increased in their horizonal face length L at regular intervals of 0.5 mm, and are separately gradually decreased in the thickness of their ball hitting portions at regular intervals of 0.5 mm.

In the conventional iron set, the thickness of the ball hitting portions of the component irons is small at their upper portions, and becomes greater according to the approach to their sole portions. Therefore, the thickness of the ball hitting portions which is shown in Table 1 is as measured in the vertical middle of the ball hitting portion of each component iron.

That is to say, since in the present invention, as shown in FIG. 4, the face 7 and the bottom surface 1*a* of the cavity are substantially parallelized with each other so that the thickness T of the ball hitting portion is uniform or even at any portion thereof, the ball hitting portion, or the head is allowed to be furnished with a greater amount of mass in the peripheral portion thereof, to thereby achieve an increase in the moment of inertia which acts upon the head, as shown in Table 2.

Table 2 shows measured values of the moment of inertia, M which acts upon the head of each size number of iron in connection with the conventional iron set and the iron set of the present invention, which are both as indicated in Table 1.

TABLE 2

| | Moment of Inertia (M) ($g\text{-}cm^2$) | |
|---|---|---|
| | Iron Set of the Present Invention | Conventional Iron Set |
| No. 3 Iron | 2950 | 2350 |
| No. 4 Iron | 2910 | 2410 |
| No. 5 Iron | 2870 | 2470 |
| No. 6 Iron | 2830 | 2530 |
| No. 7 Iron | 2790 | 2590 |
| No. 8 Iron | 2750 | 2650 |
| No. 9 Iron | 2710 | 2710 |
| Pitching Wedge | 2680 | 2790 |

Also, Table 2 shows that in the conventional iron set, the moment of inertia, M upon the heads of the component irons decrease in the value thereof according to a decrease in their size numbers, while on the other hand, in the iron set of the present invention, the moment of inertia, M upon the heads of the component irons gradually increase in the value thereof according to a decrease in their size numbers.

In the present invention, therefore, a lower size number of irons are allowed to still more increase in the moment of inertia, M upon their heads. This improves the ball orientability of each iron in which the flying direction of a golf ball hit thereby is controlled, and overcomes a disadvantage of the conventional iron set in which a lower size number of irons are greater in the length of their shafts. Also, the iron set of the present invention allows the component irons to assume an orderly and disharmony-free external appearance. Moreover, the present invention achieves manufacture of such an iron set at a lower cost without necessitating a complicated or specific process.

I claim:

1. An iron set comprising a plurality of irons having increasing size numbers, wherein the component irons are respectively provided with a cavity in a back side thereof, and a horizontal face length of each club is gradually increased according to a decrease in the respective size numbers, while at the same time, the thickness of a ball hitting portion from the face to the bottom of the cavity of each club is gradually decreased according to a decrease in size numbers of the clubs.

2. An iron set comprising a plurality of irons provided with heads constructed such that each has a cavity on a rear side, wherein a lower size number of component irons are arranged to be increased gradually in a horizontal face length of each club according to a decrease in the size number, and to be gradually decreased in the thickness of the ball hitting portion from the face to the bottom of the cavity on the back side of each club according to a decrease in the size numbers.

3. An iron set as set forth in claim 1 or 2, wherein a lower size number of component irons is increased gradually in the horizontal face length with every decrease in the size number of the clubs at a fixed dimensional difference.

4. An iron set as set forth in claim 3, wherein said fixed dimensional difference is 0.5 mm.

5. An iron set as set forth in claim 3, wherein the component irons are increased gradually in the horizontal face length with every decrease in size number at a fixed proportion.

6. An iron set as set forth in claim 1 or 2, wherein the component irons are decreased gradually in the thickness of the ball hitting portions with every decrease in the size number at a fixed dimensional difference.

7. An iron set as set forth in claim 6, wherein said fixed dimensional difference is gradually decreased is 0.5 mm.

8. An iron set as set forth in claim 1 or 2, wherein a lower size number of component irons is decreased gradually in the thickness of the ball hitting portion with every decrease in the size numbers at a fixed proportion.

* * * * *